US005271482A

United States Patent [19]

Walz

[11] Patent Number: 5,271,482

[45] Date of Patent: Dec. 21, 1993

[54] ELECTRIC LIGHT WEIGHT PORTABLE SCAFFOLDING

[75] Inventor: Lowell N. Walz, Denver, Colo.

[73] Assignee: Lowell Lift, Inc., Denver, Colo.

[21] Appl. No.: 893,681

[22] Filed: Jun. 5, 1992

[51] Int. Cl.[5] ..... E04G 1/00

[52] U.S. Cl. ..... 182/63; 182/148

[58] Field of Search ..... 187/63, 148, 127, 145, 187/146

[56] References Cited

U.S. PATENT DOCUMENTS

| | | | |
|---|---|---|---|
| 1,505 | 3/1840 | Penfield | 182/148 |
| 1,917,011 | 7/1933 | Bird | 182/148 X |
| 4,194,591 | 3/1980 | Fisher . | |
| 4,234,055 | 11/1980 | Beeche . | |
| 4,397,373 | 8/1983 | Ream, et al. . | |
| 4,498,556 | 2/1985 | Garton | 182/148 X |
| 4,569,418 | 2/1986 | Novarini . | |
| 5,067,587 | 11/1991 | Mims, Jr. et al. | 182/63 |

FOREIGN PATENT DOCUMENTS

| | | | |
|---|---|---|---|
| 8687 | 7/1840 | United Kingdom | 182/148 |

*Primary Examiner*—Alvin C. Chin-Shue

*Attorney, Agent, or Firm*—H. Kenneth Johnston, II

[57] ABSTRACT

A light weight, easily assembled, readily portable by a single individual, adjustable to most any terrain electric scaffold having a base with a plurality of outrigger members with adjustable feet to accommodate differential terrain wherein the base is affixed to a mast having a drive unit thereon capable of raising and lowering the work platform affixed thereto. The drive unit is plugged into any 110 outlet providing the required power for raising and lowering the work platform.

6 Claims, 6 Drawing Sheets

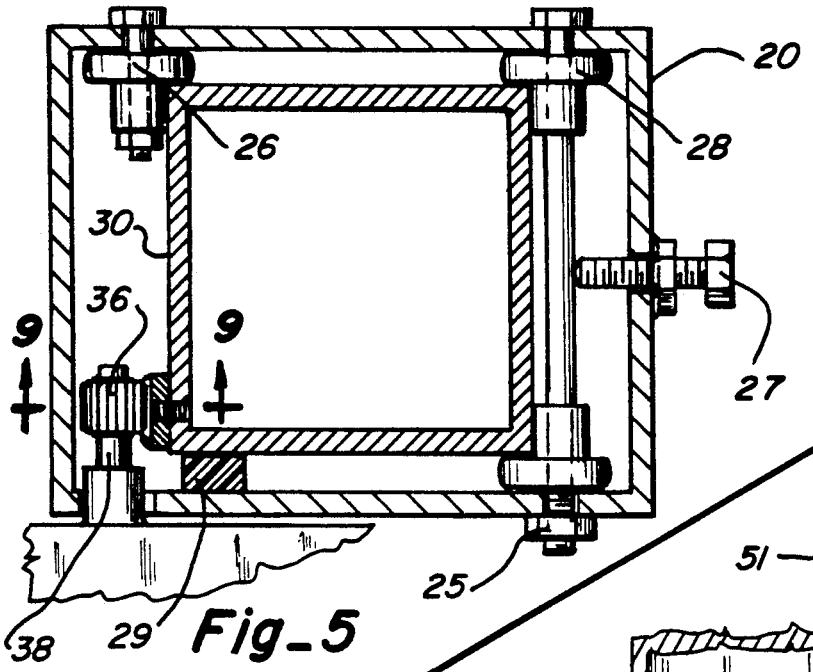
Fig_5
Fig_6
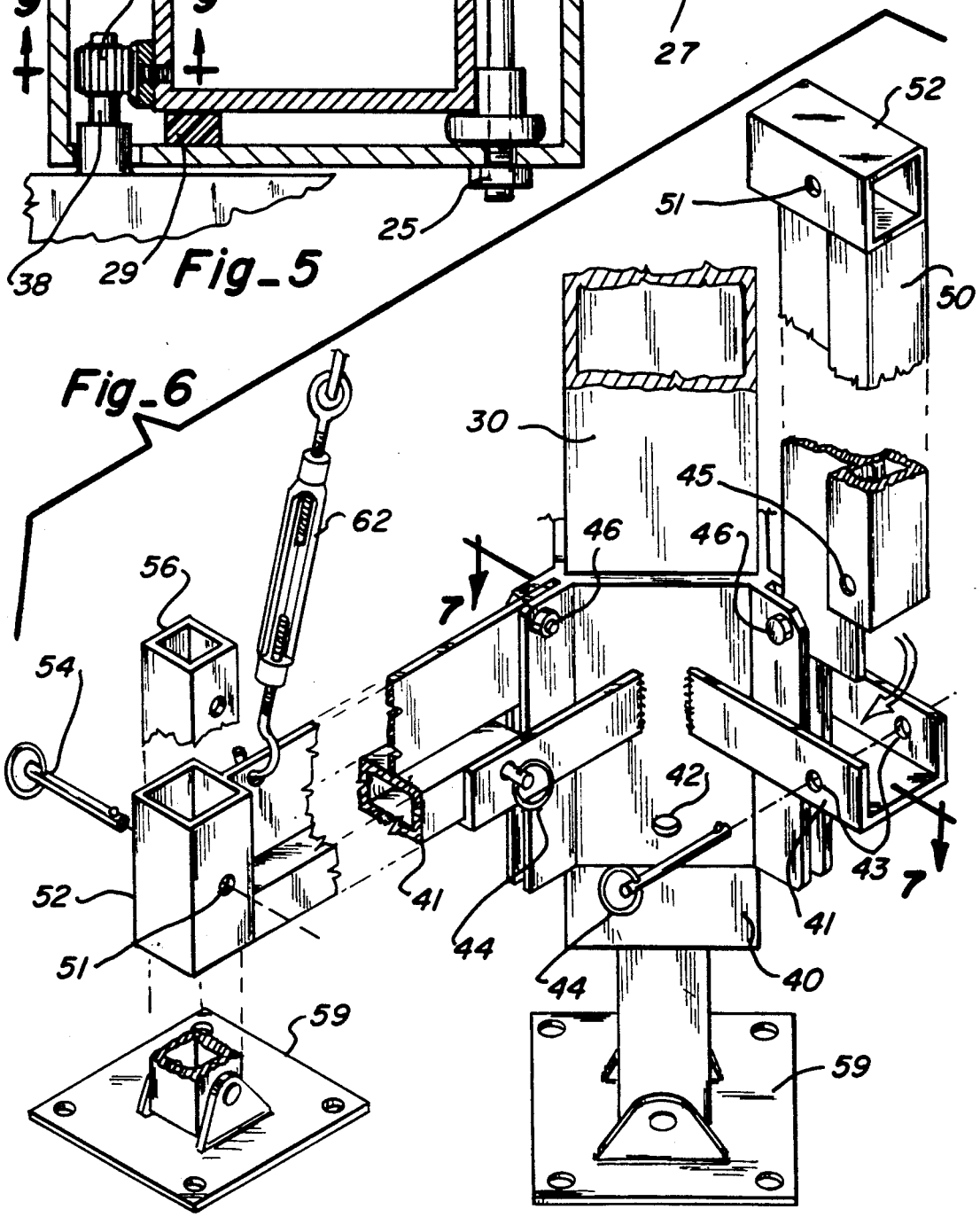

ELECTRIC LIGHT WEIGHT PORTABLE SCAFFOLDING

FIELD OF THE INVENTION

The present invention relates to light weight easily assembled and portable scaffolding.

BACKGROUND OF THE INVENTION

In building structures or repairing buildings, scaffolding is used as a work platform in order that workers can access raised portions that are not accessible from the ground. Some typical uses of scaffolding are in painting buildings, hanging rain gutter on steep roofs, laying of bricks or masonry and any other work which requires a worker to be off the ground to complete the task.

The most common scaffold is probably two sawhorses with a plank between them, however, this does not allow for work at extended heights. Another extremely common scaffold is the build as you go which must be torn down to move when that portion of the building or work area is complete. It also requires that the work station be torn down each time as elevation change is necessary.

There are also some mobile scaffolding which utilize a vertical tower structure in which the work platform is mounted on the tower and is driven up and down by motor. The device does not require a tear down to change elevation of the work station as the platform merely moves up and down the tower. Such devices are not easily utilized except on relatively flat terrain without obstacles.

Although the mobile scaffold is an improvement to the typical fixed scaffold, it lacks versatility to used where there are various obstacles such as fences and uneven terrain. In U.S. Pat. No. 5,067,587, Mims, Jr. et al, discloses a mobile scaffold, however it is a very bulky unit designed to be moved around by a vehicle and is not capable of accommodating obstacles and rough terrain.

In U.S. Pat. No. 4,194,591, Fisher discloses a pedestal scaffold which can be rolled around by a single person, however the device is bulky, not easily transported and is not beneficial for use on rough terrain or where there are various obstacles such as fences and the like.

Ream et al, U.S. Pat. No. 4,397,373 discloses a mobile pedestal scaffold having similar disadvantages as Fisher above. It is bulky, not easily transported and is basically unusable on rough terrain.

Novarini, U.S. Pat. No. 4,569,418 discloses a system which may be used as a fire escape for tall buildings however would be impractical for use as a scaffold and has all the disadvantages previously described as well as it is incapable of being easily transported by an individual.

Although Beeche, U.S. Pat. No. 4,234,055 shows a unique movable roof mounted suspension scaffold system it is quite cumbersome with extensive time required for tear down or erection and could not be managed by a single individual or easily transported.

As can be seen by the prior art there are no scaffold devices currently available which provide the benefits of being light weight, easily transported by a single individual such as in the back of a pickup truck, has minimum time required to set up or tear down and is readily adaptable to rough terrain and obstacles.

Additionally, one of the major difficulties with the use of scaffolding is the additional time required for the assemble and disassembly of the scaffolding. Even with the so called mobile scaffolding described hereinabove, there is substantial amounts of time required to get the equipment ready so that the actual work intended to be performed can be started. Additionally, the small contractor generally does not have the financial where with all to purchase these types of equipment even if they could do the job which they will not. Instead, many times a plank is run been two ladders or some other make shift device is utilized.

SUMMARY OF THE INVENTION

It is an object of the present invention to provide a light weight, portable, easily assembled electric lift which can be utilized on rough terrain and around obstacles such as fences and the like.

The portable scaffolding unit of the present invention includes a mast, a drive unit for raising and lowering the work platform, a base having outriggers with feet adjustable to rough terrain. The base is removable from the mast and the outriggers on the base fold up after the feet are removed from the outrigger for ease of being transported by a single individual. The mast which is sectioned for ease of transporting and use may be used with the sections together or individually when the full height of the device is not required. The mast has a rack mounted on it which is part of the drive means for raising and lowering the work platform. The drive unit has an electric motor with a 90 degree gear box and a pinion gear for interacting with the rack for raising and lowering the work platform.

If the portable scaffolding is to be used on flat surfaces, locking castors may be attached to the feet for further ease of movement of the scaffold.

It is another object of the present invention to provide a simple light weight, portable easily assembled electric lift which can be used singlely or in conjunction with another light weight portable easily assembled electric lift. The single unit would have a single basket work platform. When the present invention was used with another unit, it may be interconnected electrically so that the work platform on both units are raised and lowered in concert allowing a single individual to operate the device, however, where desired, each unit may be operated independently of each other where two individuals are utilizing the devices and need to have slightly different heights. When two units are utilized, a platform is extended between them forming a large work station on a single scaffolding.

As a further object of the invention it is the intention to provide a unit that is quickly assembled and disassembled and is easily transported without the need for a special vehicle thus reducing the time required to perform the intended task. Job site time is thus reduced making the job more profitable for contractor and less expensive for the building owner.

The present invention can be quickly assembled or disassembled and transported in the back of a pickup which is the vehicle utilized by many small contractors.

BRIEF DESCRIPTION OF THE DRAWINGS

FIG. 5 is a partial top cross-sectional view of the drive unit of FIG. 4 taken along the lines 5—5.

FIG. 6 is partial sectional view of the base unit.

DETAILED DESCRIPTION OF THE PREFERRED EMBODIMENT

Figure 1:
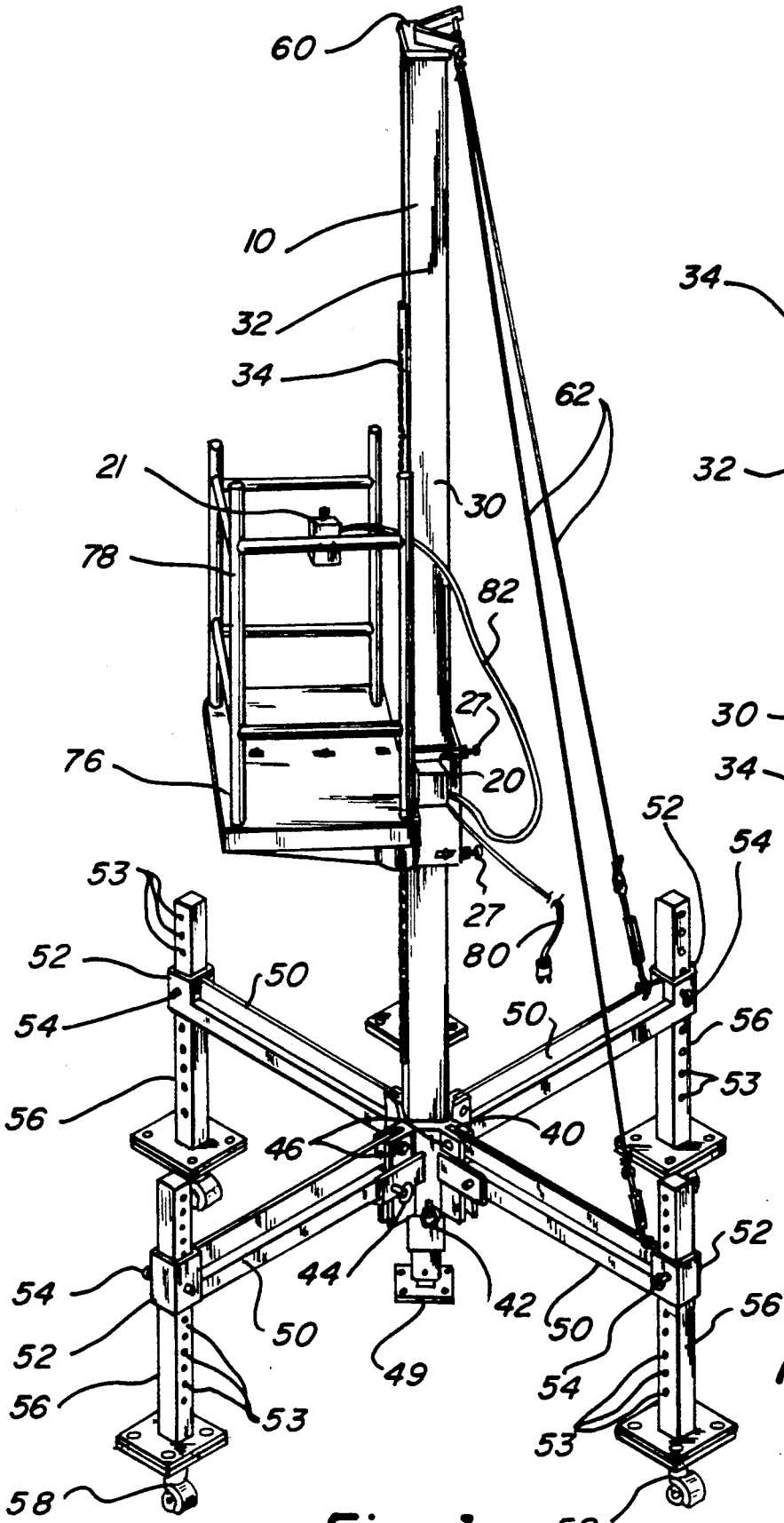
FIG 1 is a perspective view of the portable scaffolding unit of the present invention, in accordance with a preferred embodiment.
Figure 2:
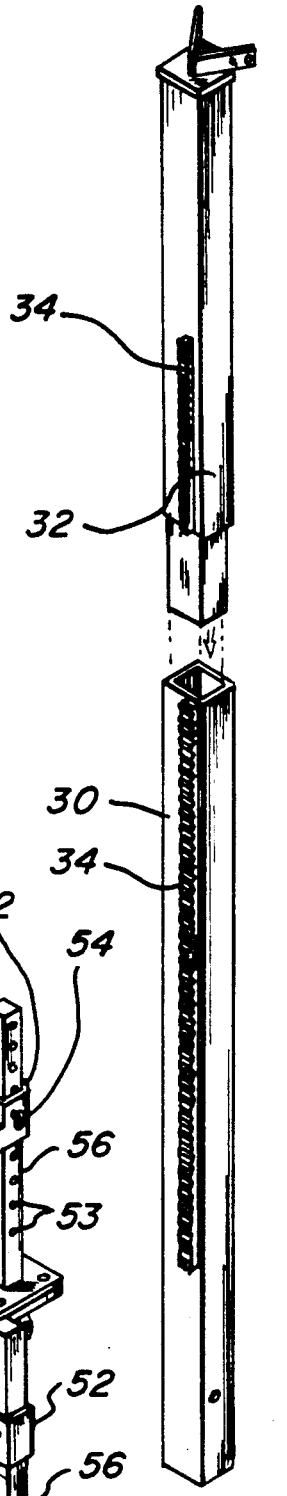
FIG. 2 is a side view of the mast sections.
Figure 3:
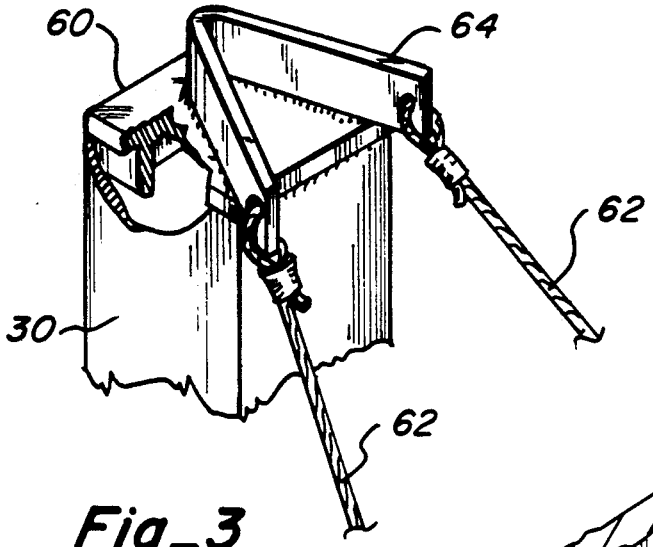
FIG. 3 perspective view of the top cap of the mast.

In FIG. 1 there is shown a perspective view of the portable scaffolding unit 10 of the present invention, in accordance with a preferred embodiment. The portable scaffolding unit 10 is generally used by setting it up adjacent to the wall or area of a building or structure to be worked on. The portable scaffolding unit 10 provides the worker a single basket platform 76 which moves up and down along the work area. The portable scaffolding unit 10 includes mast 30 and extension mast 32, drive unit 20, base 40, a plurality of outrigger 50, and a plurality of adjustable feet 56. The mast 30 and extension mast 32 are made of a strong light weight material such as aluminum and has a rack 34 affixed to one side as shown in FIG. 2. When mast 30 and extension mast 32 are used together, the worker can reach a height of approximately 30 feet. Mast 30 and extension mast 32 are joined together in a manner that the rack 34 of mast 30 and the rack 34 of extension mast 32 meet so as to provide a single continuous rack and the drive unit 20 will continue moving up extension mast 32 from mast 30 without interruption.

When the portable scaffold 10 is being setup after being transported a clevis pin 44 is inserted into each channel aperture 43 and outrigger aperture 45 after each outrigger 50 is unfolded by pivoting outrigger 50 on pivot 46 as shown in FIG. 6. In order to make base 40 easier to move, pivot 46 may be removed allowing each outrigger 50 to be completely removed for transportation. The adjustable foot 56 is then secured in foot receiver 52 for each outrigger 50 at the height necessary to adjust for the terrain with a clevis 54 being inserted through each aperture 51 and aperture 53 for each adjustable foot 56.

Figure 4:
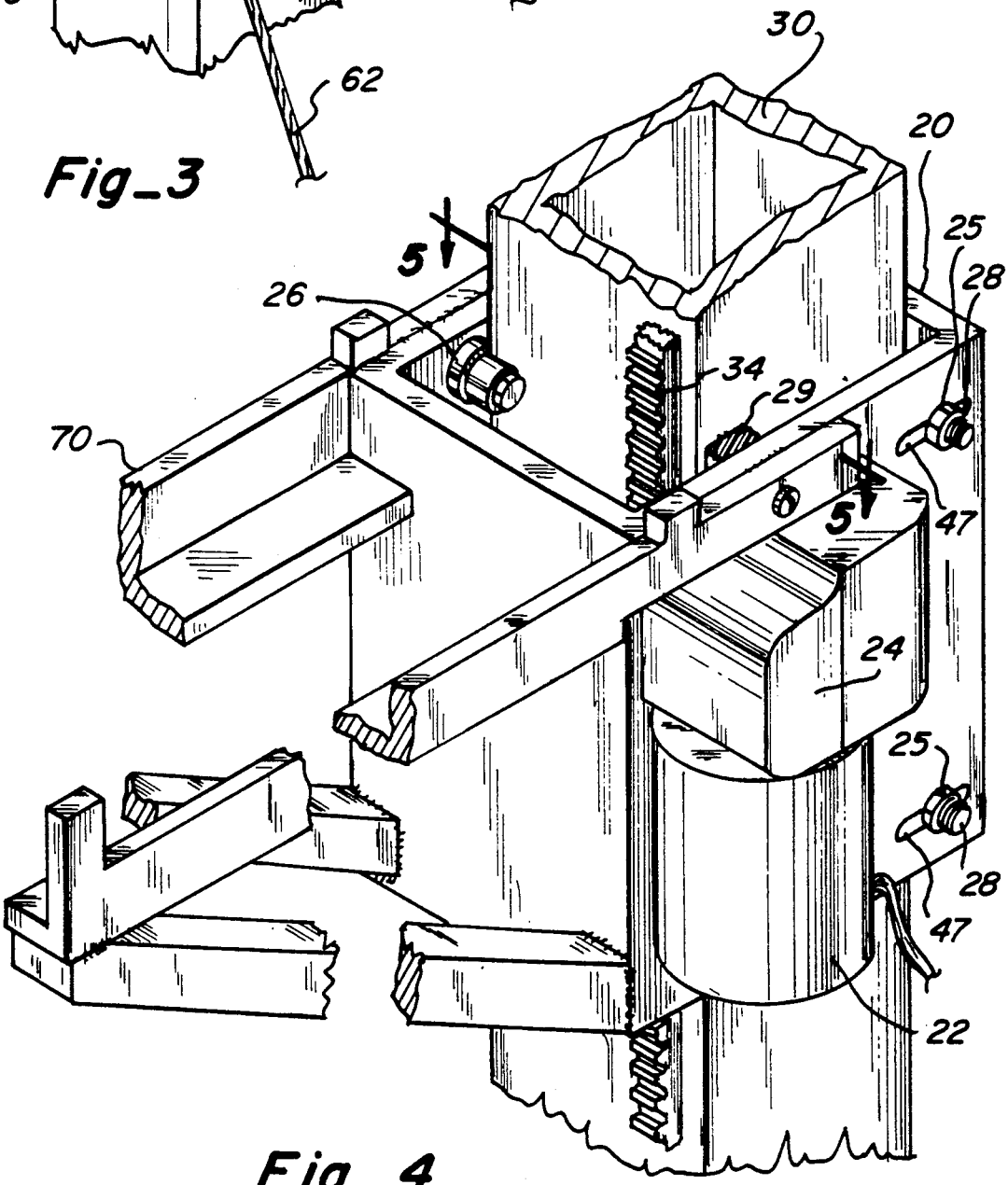
FIG. 4 is a close up partial cross-sectional of the drive unit and work station support.
Figure 7:
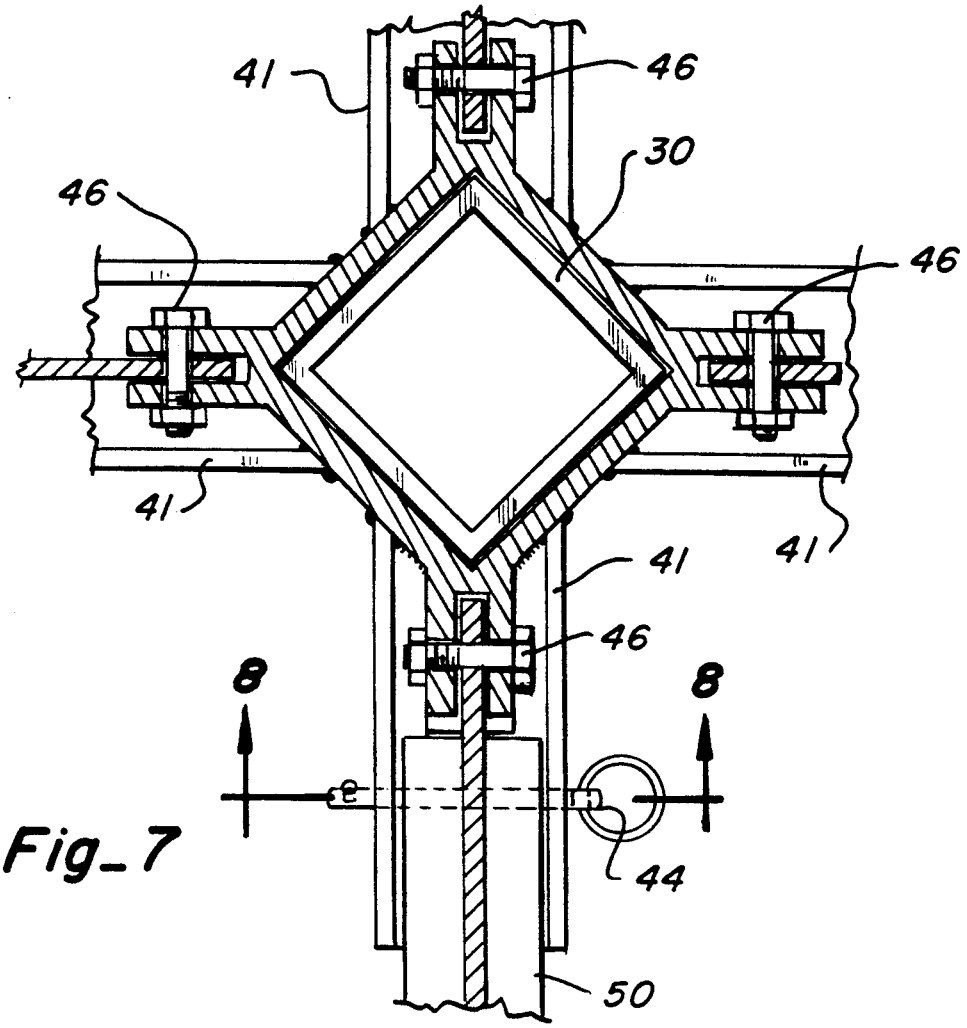
FIG. 7 is a top cross-sectional view of the base unit of FIG. 6 taken along the lines 7—7.
Figure 8:
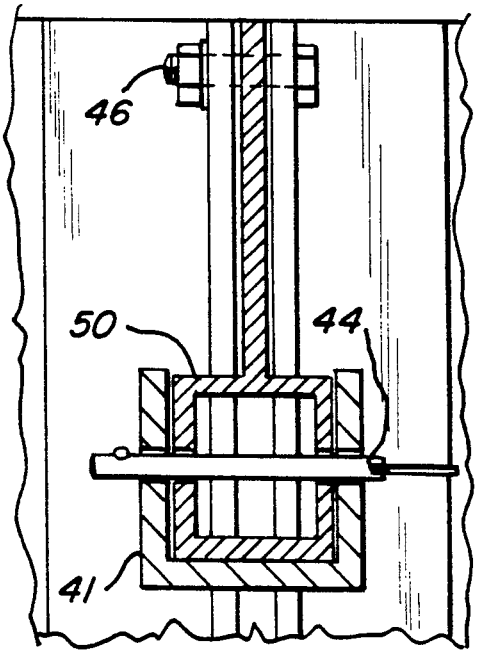
FIG. 8 is a cross-sectional of the base in FIG. 7 taken along the lines 8—8.
Figure 9:
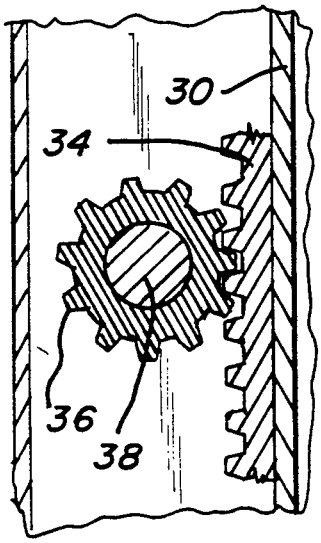
FIG. 9 is a cross-sectional of the drive unit of FIG. 5 taken along the lines 9—9.
Figure 10:
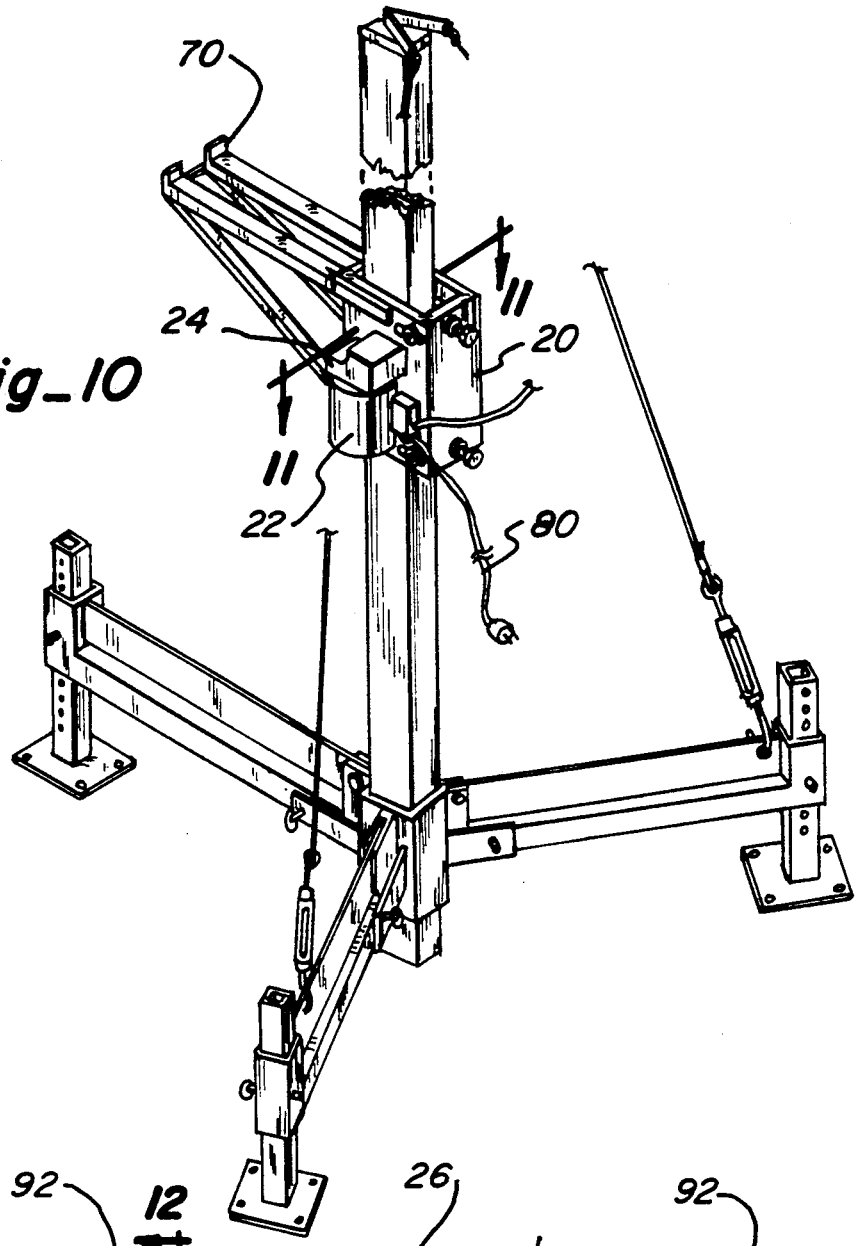
FIG. 10 a perspective view of another embodiment of the present invention.

Drive unit 20 is adjusted on mast 30 so as to engage rack 34 with pinion gear 36 by adjusting both the upper and lower adjustment screw 27 forcing rack 34 against pinion gear 36. Drive unit 20 has guide 26, adjustment guide 28 and spacer 29 to allow drive unit 20 to move up and down mast 30 without slippage or galling. Spacer 29 generally extends the full distance on the rack side of the drive unit 20. Guide 26 and adjustment guide 28 and spacer 29 are made of materials which provide excellent wear and tensile strength such as a material known as UHMWPE (Ultra High Molecular Weight Polyethylene). In operation, drive unit 20 is adjusted within adjustment slot 47 by untightning each adjustment nut 25 and advancing or retracting adjustment screw 27 so that the rack 34 and pinion gear 36 mesh without excessive pressure or slop and then each adjustment nut 25 is tightened securing drive unit 20 in place on mast 30 for proper operation as shown in FIGS. 4 and 5. Drive unit 20 has motor 22 engaged to a 90 degree gear box 24 which drives shaft 38 and pinion gear 36 and provides an automatic brake when drive unit 20 is not operating up or down as shown in FIGS. 4 and 9. Drive unit 20 is connected to a typical 110 outlet by power cord 80 as seen in FIGS. 1, 10, 13, and 14.

Figure 11:
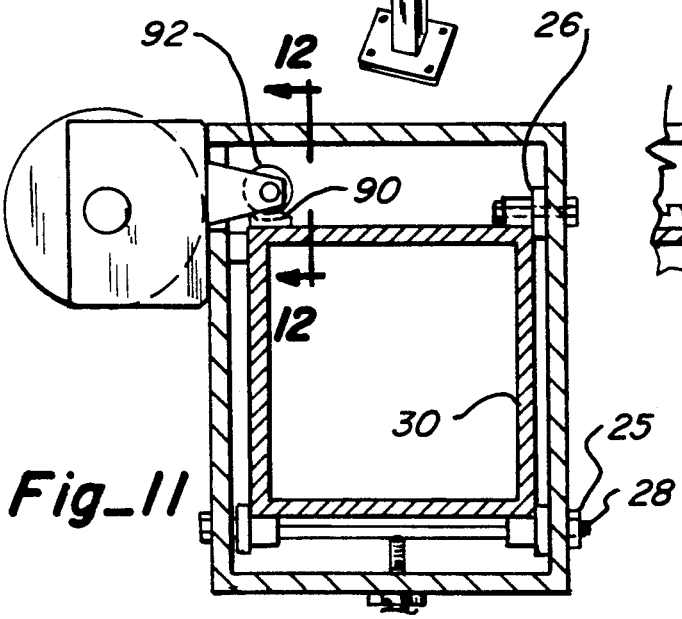
FIG. 11 is a top cross-sectional view of the drive unit of FIG. 10 taken along the lines 11—11.
Figure 12:
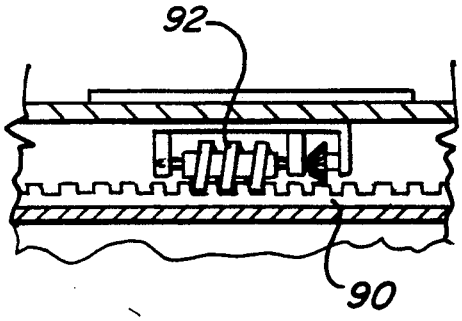
FIG. 12 is a cross-sectional view of the worm drive of the drive unit of FIG. 11 taken along the lines 12—12.

The rack 34 and pinion gear 36 system may be replaced by the rack 90 and worm gear 92 as shown in FIGS. 11 and 12. When the rack 90 and worm gear 92 are used, the 90 degree gear box 24 is eliminated as the rack 90 and worm gear 92 provide an automatic brake.

In order to provide additional stability due to the torque from the work platform 72 or single basket platform 76, adjustable guy wires 62 are affixed to the guy angle 64 of the top cap 60 and to two of the outrigger 50 adjacent to the foot receiver 52 and on the opposite side as the work platform 72 or single basket platform 76 as shown in FIGS. 1, 3, 6, 10, 13, and 14. Further support may be added for heavier loads by inserting center support 49 which is slightly smaller than the inside dimensions of the mast 30 and securing it in place by mast clevis 42 as shown in FIG. 1.

When a worker desires to move the work platform 72 or single basket platform 76 up or down, he merely presses the up or down button (not shown) on the drive unit control 21. When two portable scaffold 10 are used by a single individual, the drive unit 20 are interconnected by dual drive interconnect cable 23 and operated by drive unit control 21 as shown in FIGS. 1, 10, 13, and 14.

When portable scaffold 10 is used on rough terrain, each adjustable foot 56 and center support 49 may utilize the swivel foot pad 59 which allows all of the weight on the adjustable foot 56 to be distributed a little more evenly as shown in FIG. 6.

Figure 14:
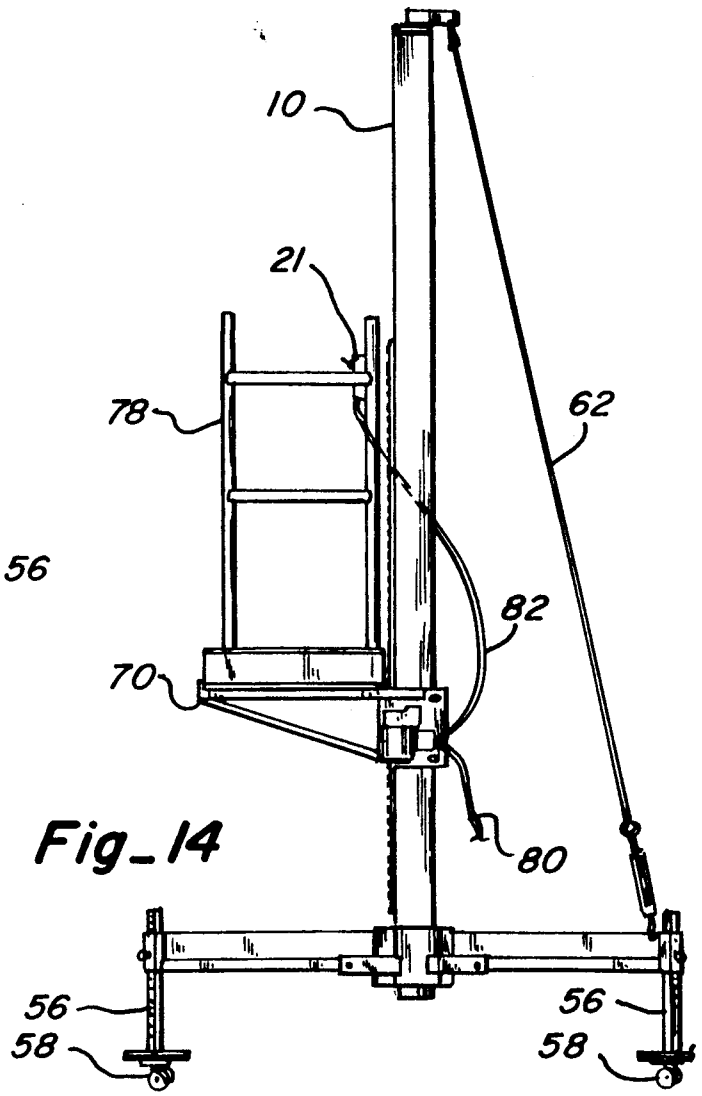
FIG. 14 is a perspective view of a single unit of the present invention, in accordance with a preferred embodiment.
Figure 13:
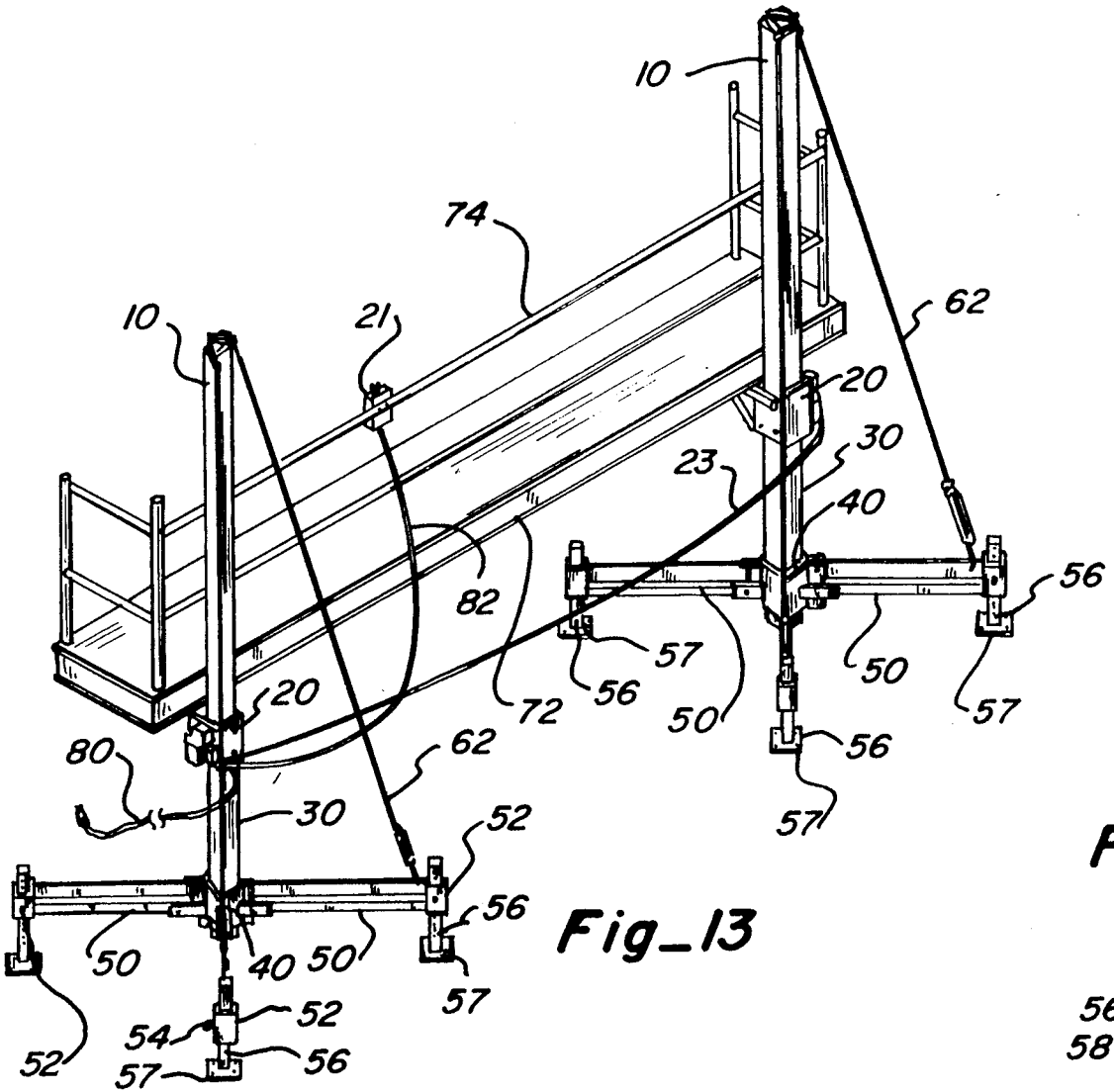
FIG. 13 is a perspective view of two of the devices of the present invention used in conjunction with each other in accordance with a preferred embodiment.

In setting up the portable scaffold 10 for use by a single individual single basket platform 76 is affixed to the platform carrier 70. When two portable scaffold 10 are to be used in conjunction with each other, platform 72 is extended between platform carrier 70 on each portable scaffold 10. Single basket platform 76 and platform 72 have stage hand rails 74 and 78 respectively as shown in FIGS. 1, 13, and 14.

Although it is understood that many substitutions may be made as to materials such as molding the mast 30 and rack 34 as a single unit out of materials such as polycarbonate or other polymeric material having high strength and wear capabilities.

In the drawings and specification there has been set forth the best mode, presently contemplated, for the practice of the present invention, and although specific terms are employed, they are used in a generic and descriptive sense only and are not for purposes of limitation. Several modifications of the specific design features illustrated herein are permissible while still retaining the essential features of the tool of this invention without departing from the scope of the applicants invention.

What is claimed is:

1. An electric light weight portable scaffold unit comprising:

a base means;

said base means comprising a hub having a plurality of clevis means which pivotally connect an outrigger means and having means to lock said outrigger means in place;

a plurality of outrigger means which is pivotally mounted to said base means at said clevis means and is detachable for ease of transportation;

said plurality of outrigger means, each having a receiver means attaching an adjustable foot means;

said base means capable of receiving and removably affixing a mast means;

said mast means having a rack means affixed thereto capable of communicating with a pinion gear means;

a drive unit means having a pinion gear means which interconnects with said rack means of said mast means providing vertical movement of said drive unit means when activated by a control means;

said drive unit means having a platform carrier means affixed thereto capable of receiving a platform means for providing a work station which is moved vertically when said drive unit means is moved vertically along said mast means.

2. The light weight portable scaffold unit of claim 1 wherein said plurality of outrigger means comprises three outriggers.

3. The light weight portable scaffold unit of claim 1 wherein said plurality of outrigger means comprises four outriggers.

4. The light weight portable scaffold unit of claim 1 wherein said mast means comprises two masts capable of being joined together with a continuous rack.

5. The light weight portable scaffold unit of claim 1 wherein said adjustable foot means includes a detachable locking castor means.

6. A light weight portable scaffold comprising:

a base;

said base comprising a hub having a plurality of clevis and having a plurality of outrigger's mounted pivotally at one end of said outrigger to said clevis wherein said outrigger is capable of being secured in the extended most position;

said outrigger's having a adjustable foot adjustably affixed at the other end of said outrigger;

said base having a mast removably mounted for ease of transportation when said mast is removed;

said mast having a rack affixed thereto;

a drive unit movably affixed to said mast;

said drive unit having a pinion gear cooperating with said rack to move said drive unit vertically along said mast;

said drive unit having a work platform for personnel and materials;

said mast having a top cap providing an adjustable guy wire affixed to two said outriggers opposite said work platform at the end nearest said adjustable foot providing additional stability to said portable scaffold when said portable scaffold is utilized in a work environment.

* * * * *